US007677216B2

(12) United States Patent
Sugano et al.

(10) Patent No.: US 7,677,216 B2
(45) Date of Patent: Mar. 16, 2010

(54) ENGINE START CONTROLLER

(75) Inventors: Norihiko Sugano, Nishikamo-gun (JP); Tsuyoshi Tadanaga, Kariya (JP); Hiroshi Funakoshi, Okazaki (JP)

(73) Assignee: Mitsubishi Jidosha Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/036,493

(22) Filed: Feb. 25, 2008

(65) Prior Publication Data

US 2008/0210187 A1 Sep. 4, 2008

(30) Foreign Application Priority Data

Mar. 2, 2007 (JP) ..... 2007-052674

(51) Int. Cl.
*F02N 17/00* (2006.01)

(52) U.S. Cl. ..... 123/179.3; 307/10.6

(58) Field of Classification Search ..... 123/179.1, 123/179.2, 179.3; 307/10.6
See application file for complete search history.

(56) References Cited

U.S. PATENT DOCUMENTS 5,074,275 A * 12/1991 Fukui ..... 123/613
5,848,577 A * 12/1998 Sappe et al. ..... 123/179.3
6,024,065 A * 2/2000 Hojna et al. ..... 123/179.3
6,148,781 A * 11/2000 Boegner et al. ..... 123/179.3
2001/0047785 A1 * 12/2001 Osada et al. ..... 123/179.3
2007/0245998 A1 * 10/2007 Yamaguchi et al. .... 123/179.25

FOREIGN PATENT DOCUMENTS

JP 2005-16388 A 1/2005
JP 2006-22661 A 1/2006
JP 2006-183613 A 7/2006

* cited by examiner

*Primary Examiner*—Stephen K Cronin
*Assistant Examiner*—Anthony L Bacon
(74) *Attorney, Agent, or Firm*—Birch, Stewart, Kolasch & Birch, LLP

(57) ABSTRACT

An engine start controller having a starter motor that is driven by battery to start engine, an activation switch that sends to the starter motor a START command for starting the engine, an activation circuit that connects the starter motor to the battery to supply a drive current, and an engine start control unit that issues an OPERATE command for operating the activation circuit when receiving the START command from the activation switch, and supplies the drive current to the starter motor. The controller is provided with a bypass circuit that directly sends to the activation circuit the START command that has been sent from the activation switch.

11 Claims, 6 Drawing Sheets

ENGINE START CONTROLLER

BACKGROUND OF THE INVENTION

1. Field of the Invention

The present invention relates to an engine start controller having a starter motor for starting an engine by using a battery as power source, and more specifically to an engine start controller that is suitable to start the engine in a situation where an electrical control unit (ECU) for controlling the engine start becomes inoperative due to a temporary voltage drop of the battery which is caused at the engine start.

2. Description of the Related Art

As to engine start controllers that start engines by driving the starter motors installed in vehicles, a well-known controller is provided with a power source control ECU for performing the drive control of the starter motor and an engine ECU that carries out the drive control of the engine (see, for example, Unexamined Japanese Patent Application No. 2006-183613). An engine start controller of this type is suitable especially when the engine start controller has a smart ignition system.

The smart ignition system conducts ID check of a vehicle and a key by wireless. If the ID is matched, the system starts the engine in response to the driver's pressing an operation unit (starter switch) such as a press-button switch that is disposed in a vehicle compartment. The smart ignition system is also called Push Start System.

An engine start controller of this type improves operationality. On the other hand, in a situation where a battery with decreased capacity is used to start the engine, the battery voltage is transiently reduced due to a high current that flows into the starter motor. As a result, the ECU of the engine start system becomes inoperative, which occasionally disables the engine to start.

In order to solve the inoperativeness of the ECU of the engine start system, the engine start controller disclosed in the above-mentioned publication is designed so that a lower limit of operating voltage of the power source control ECU is set lower than a lower limit of operating voltage of the engine ECU. Even if the battery voltage is temporarily reduced lower than the operating voltage of the engine ECU when the starter motor is driven while the battery capacity is decreased, the engine can be started as long as the battery voltage is maintained at such a level that allows the power source control ECU to properly operate.

The engine start controller of the publication, however, requires to install the power source control ECU for implementing the drive control of the starter motor, separately from the engine ECU, detect the operation of the engine ECU by using the power source control ECU, and preliminarily maintain a detection result in the power source control ECU. In addition, the lower limit of operating voltage of the power source control ECU has to be set lower than that of the engine ECU for ensuring startability. Consequently, the controller described in the publication raises the concern that costs may be high. Also, its complicated structure causes a high incidence of malfunctions.

Moreover, if an improper operation of a CPU, such as microcomputer constructing the ECU, leads to a wrong judgment that the starter switch is pressed (constant ON state of a register), the engine might be improperly started.

One possible way to solve these problems is to form the configuration from the starter switch to the ECU of the engine start system into a redundant configuration.

However, the engine start controller with a redundant configuration has a complicated structure, and therefore increases costs.

SUMMARY OF THE INVENTION

The present invention has been made to solve the above-described problems. It is an object of the invention to provide an engine start controller capable of reliably detecting a user's pressing of a starter switch and also capable of credibly preventing a false start of an engine with a simple structure even if a battery is reduced in capacity.

In order to achieve the object, the engine start controller according to the invention has a battery; a starter motor that is driven by the battery to start an engine; an activation switch that sends a START command for starting the engine to the starter motor; an activation circuit that connects the starter motor to the battery to supply a drive current; and an engine start control unit that issues an OPERATE command for operating the activation circuit when receiving the START command issued by the activation switch, and supplies the drive current to the starter motor. The engine start controller is also provided with a bypass circuit that directly sends to the activation circuit the START command that has been sent from the activation switch.

A further scope of applicability of the present invention will become apparent from the detailed description given hereinafter. However, it should be understood that the detailed description and specific example, while indicating embodiments of the invention, are given by way of illustration only, since various changes and modifications within the spirit and scope of the invention will become apparent to those skilled in the art from this detailed description.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE INVENTION

An engine start controller according to the present invention will be described below with reference to the attached drawings.

Figure 1:
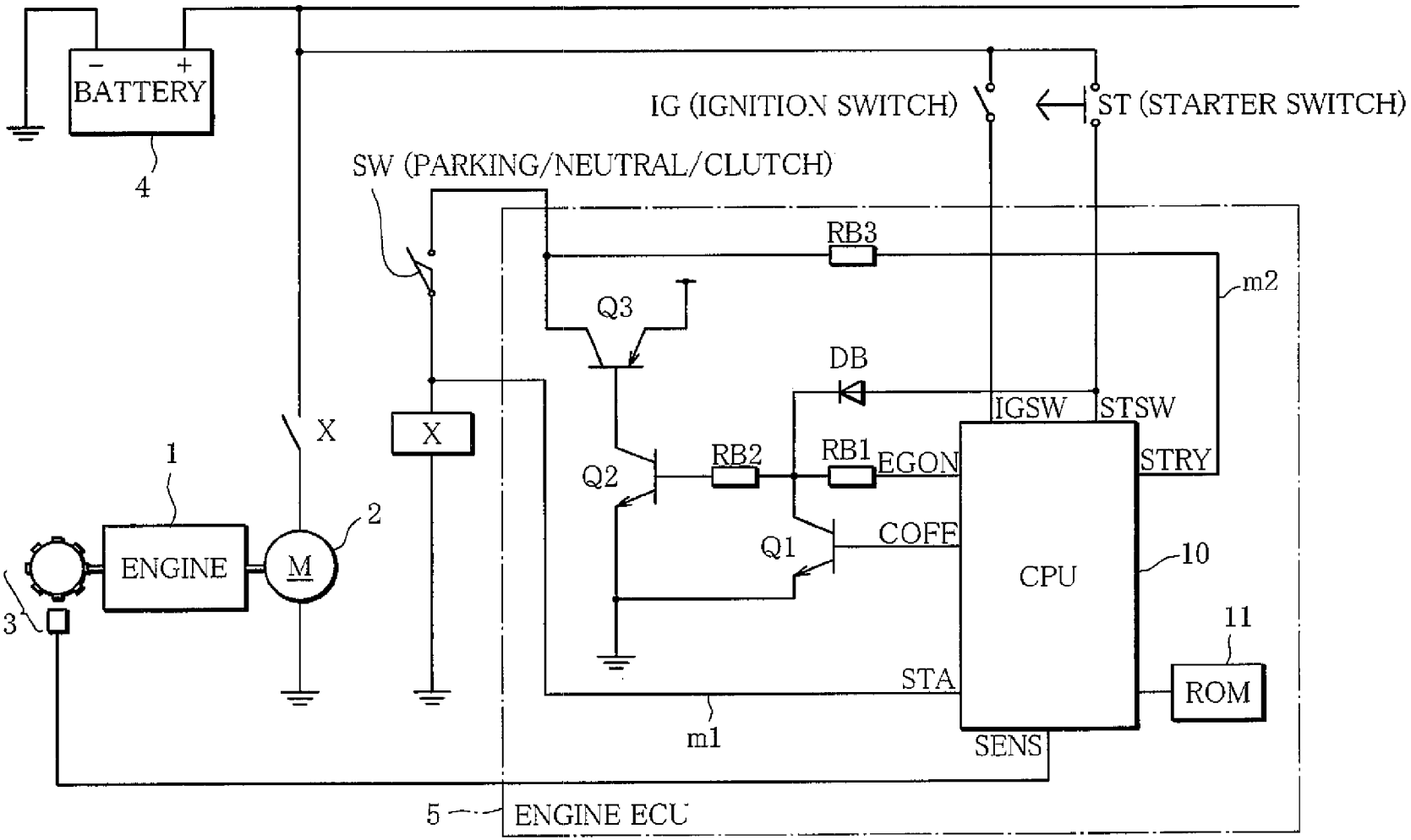
FIG. 1 is a block diagram showing a structure of a substantial part of an engine start controller according to one embodiment of the present invention.
Figure 2:
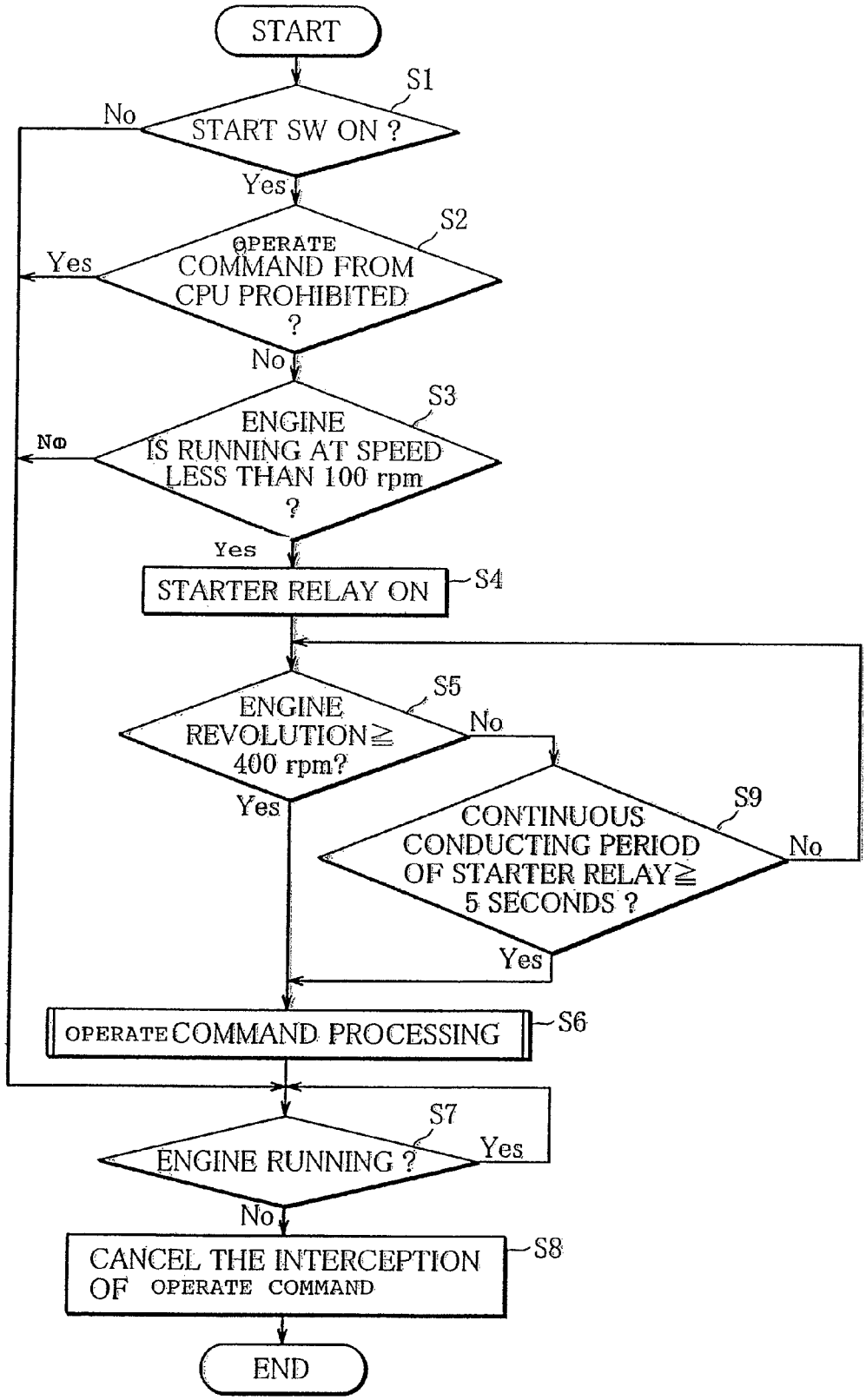
FIG. 2 is a flowchart showing an operation procedure of the engine start controller shown in FIG. 1.

FIG. 1 shows an engine installed in a vehicle, which is started by the engine start controller of the invention. The vehicle includes a starter motor 2 that starts the engine by providing torque to an engine 1, a crank angle sensor 3 that is mounted on the engine 1 and serves as revolution-detecting means that detects a revolution state of the engine 1, a battery 4 that supplies power to the starter motor 2, various electronic devices and the like, which are installed in the vehicle, and an engine start control unit (engine ECU) 5 that provides the starter motor 2 with power sent from the battery 4 and starts the engine 1.

A revolution detection signal that is obtained by the crank angle sensor 3's detecting the revolution state of the engine is entered to a revolution-detection input terminal SENS of the engine ECU 5.

Instead of using the crank angle sensor 3, it is possible to use as the revolution-detecting means, for example, an input/output signal for engine control, a signal indicative of a power generation state of a generator attached to the engine 1, an electric current signal of the battery, a signal indicative of a hydraulic state of the engine or the like, although not particularly shown. It is also possible to use two or more of the foregoing signals in combination. In short, the revolution-detecting means is not particularly limited, but has only to detect the revolution of the engine 1.

The CPU 10 for controlling the engine ECU 5 has an operation-enable-signal input terminal IGSW that receives an operation-enable signal outputted from an ignition switch IG that is operated by a user to provide devices installed in the vehicle, including the engine 1, with an ENABLE command for allowing the devices to start operations thereof, and a start-signal input terminal STSW that receives a start signal outputted from a starter switch ST that implements a start operation of the engine 1. The CPU 10 determines that prescribed start conditions are satisfied, and outputs an engine activation signal for giving the ACTIVATE command from an activation-signal output terminal EGON to an after-mentioned activation circuit. Interposed in the activation-signal output terminal EGON is a current-limiting resistor RB1 that is connected to a base of a transistor Q2 whose emitter is grounded. The base of the transistor Q2 and the start-signal input terminal STSW of the CPU 10 are connected with a diode DB.

The engine start controller also has a bypass circuit that connects the starter switch ST to the base of the transistor Q2. The bypass circuit is provided with a diode DB, and an anode of the diode DB is connected to the start-signal input terminal STSW, and a cathode of the diode DB is connected to the base of the transistor Q2 through a current-limiting resistor RB2.

The transistor Q2 has a collector connected to a base of a transistor Q3 whose emitter is connected to a positive terminal of the battery 4. A collector of the transistor Q3 is connected to one end of a switch SW. When the vehicle is in a startable state, the switch SW detects the startable state and closes the circuit. Startable states include a parked state with a parking brake, not shown, being operated, and a state where a transmission of the vehicle is in neutral, if the vehicle is an automatic transmission vehicle, and a state where a clutch pedal is pressed down if the vehicle is a manual transmission vehicle.

The transistors Q2 and Q3 serve a function that sends an operation signal for operating a relay X. The startable state that is detected by the switch SW is transmitted to a startable input terminal NEUT (not shown) of the CPU 10, whereby the CPU 10 is capable of detecting whether the vehicle is in the startable state. The other end of the switch SW is connected to one end of a coil of the relay X, whose other end is grounded, so as to activate a contact point of the relay X that connects one end of the starter motor 2, whose other end is grounded, to the positive terminal of the battery. The relay X connects the starter motor 2 to the battery 4 and supplies a drive current.

The base of the transistor Q2 is connected with a collector of a transistor Q1 whose emitter is grounded. The transistor Q1 has a base connected to a start intercept terminal COFF of the CPU 10. The transistor Q1 serves as an intercept unit that intercepts an OPERATE command output from the activation-signal output terminal EGON if the OPERATE command is sent to the activation circuit formed of the transistors Q2 and Q3 in spite that the CPU 10 does not receive a START command from the starter switch ST.

A line m2 extending through a current-limiting resistor RB3 from a line connecting the transistor Q3 and the switch SW is connected to a relay status detection terminal STRY of the CPU 10. A line m1 connecting the switch SW and the relay X is connected to a relay voltage detection terminal STA that detects a condition of voltage supplied to the relay X.

The operation of the engine start controller according to the invention, which is constructed generally as stated above, will be described below with reference to flowcharts shown in FIGS. 2 to 5.

The flowchart shows an operation procedure performed when the starter motor 2 is rotated to start the engine 1 in a situation where the battery 4 is insufficient in capacity, and a high current that flows in the starter motor 2 transiently reduces the voltage of the battery 4 (instantaneous voltage drop) until a voltage value of the battery 4 falls below a lower limit of operating voltage of the engine ECU 5. In addition, the flowchart is applied to a situation where the parking brake, not shown, is operated to bring the vehicle into the parked state, and where the transmission of the vehicle is neutral. The flowchart is also applied, if the vehicle is a manual transmission vehicle, to a situation where the clutch pedal is pressed down (startable state) with the switch SW in a closed position.

Figure 6:
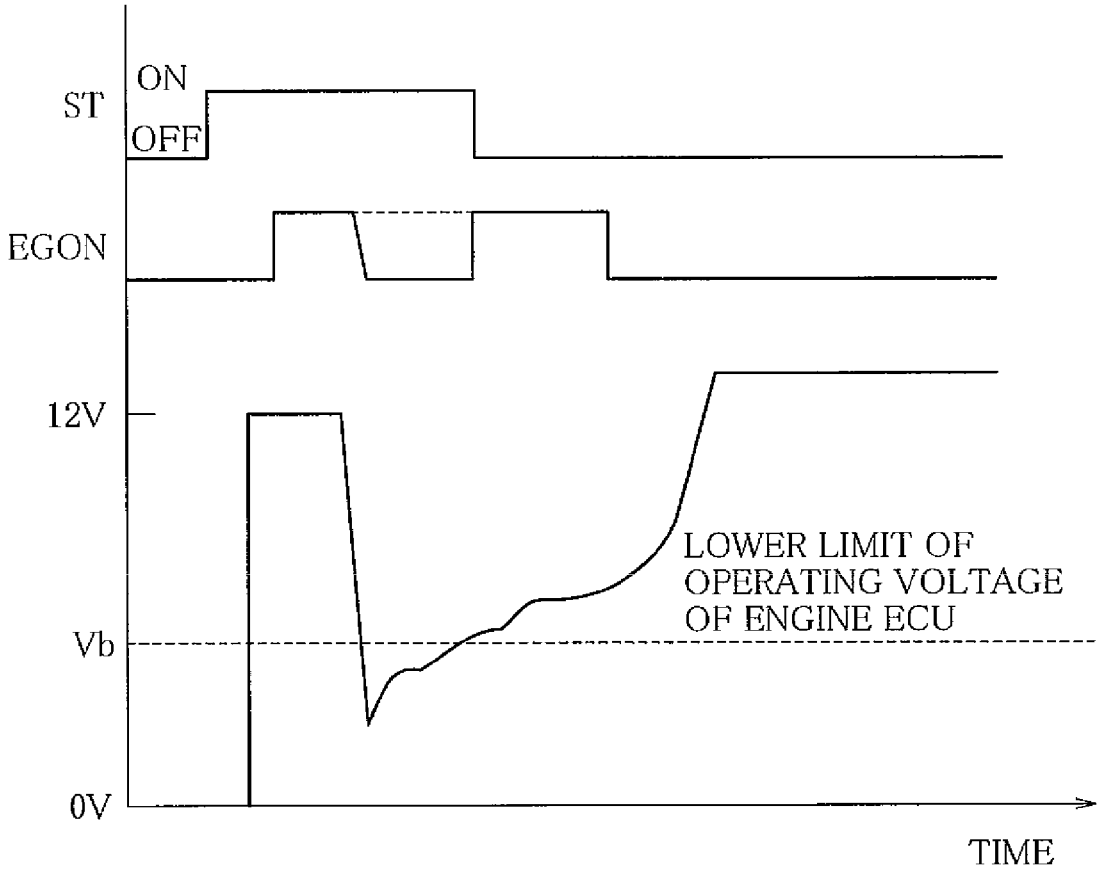
FIG. 6 is a graph showing changes in an operation signal of the engine start controller and battery voltage at engine start.

When the starter switch ST is pressed down, the START command signal is sent to the start-signal input terminal STSW of the CPU 10. When it is determined that the starter switch ST is pressed down (Step S1), the CPU 10 confirms that an after-mentioned OPERATE command prohibition flag is not set (Step S2), and outputs the OPERATE command signal from the activation-signal output terminal EGON. At this point of time, the starter motor 2 is not supplied with power from the battery 4. Therefore, the voltage of the battery 4 is maintained substantially at a stipulated value (12 V, for example) as shown in FIG. 6.

At the same time, when the starter switch ST is pressed down, the START command signal is sent to the base of the transistor Q2 and turns on the transistors Q2 and Q3, thereby activating the relay X to operate the starter motor 2 and rotates the engine. Therefore, the bypass circuit directly operates the relay X as soon as the START command has been generated by pressing the starter switch ST. The bypass circuit makes it possible to start engine without fail even in a situation where the voltage of the battery 4 is transiently reduced by the start inrush current flowing through the starter motor 2 at the time of starting the engine with the battery 4 reduced in capacity, and the engine ECU 5 is disabled by the voltage drop and fails to send the OPERATE command to the relay X.

Once the OPERATE command signal is output, electric current flows into the base of the transistor Q2 through the current-limiting resistors RB1 and RB2, and the transistor Q2 is switched from OFF to ON. At the same time when the transistor Q2 is switched to ON, the transistor Q3 is switched from OFF to ON, too. The coil of the relay X of the activation circuit is then excited to close the contact point X. The closing of the contact point X supplies the power of the battery 4 to the starter motor 2, so that the engine 1 is started The starter motor 2 starts rotating at this point, and a high-level start inrush current transiently flows from the battery 4 to the starter motor 2. As a result, terminal voltage of the battery 4 is rapidly reduced. The voltage of the battery 4 then falls below the lower limit of the operating voltage of the engine ECU 5 (CPU 10) due to insufficient capacity. The engine ECU 5 then stops functioning, and the activation-signal output terminal EGON of the CPU 10 becomes inactive (or irregular).

When the START switch ST is pressed down, the START command from the starter switch ST continues to be transmitted to the base of the transistor Q2 through the bypass circuit connected to the base of the transistor Q2. Accordingly, the coil of the relay X is excited, and the contact point X is maintained in the closed position. Along with a reduction of the transient start inrush current to the starter motor 2, the voltage of the battery 4 is gradually restored to excess the lower limit of the operating voltage of the engine ECU 5. As a result, the engine ECU 5 (CPU 10) starts to operate.

When the CPU 10 starts to operate, the crank angle sensor 3 makes a determination as to whether the engine 1 is running, and whether the revolution is less than 100 rpm (engine start determination) (Step S3). If the CPU 10 determines that the engine 1 is running at a revolution less than 100 rpm, due to the operation of the starter motor 2 by the activation of the relay X through the bypass circuit, from the detection signal transmitted from the crank angle sensor 3 in Step S3, the CPU 10 outputs the OPERATE command from the activation-signal output terminal EGON and turns on the contact point X (Step S4).

In Step S4, the OPERATE command from the activation-signal output terminal EGON is provided to the base of the transistor Q2 through the current-limiting resistors RB1 and RB2, whereby the transistor Q2 is kept ON. At the same time when the transistor Q2 is kept ON, the transistor Q3 is kept ON, too. The contact point X is therefore maintained in the closed position. Accordingly, even if the starter switch ST is opened, the contact point X is kept closed. The power of the battery 4 is supplied to the starter motor 2, to thereby cause the engine 1 to continue the start operation.

Once the engine 1 is started in Step S4, and the crank angle sensor 3 detects that the revolution speed of the engine 1 excesses a start end speed (for example, 400 rpm: complete explosion end speed) (Step S5), the CPU 10 carries out an after-mentioned OPERATE command processing (Step S6).

After the complete explosion of the engine 1, the CPU 10 stays in a standby state until the engine 1 is stopped (Step S7). If Step S7 detects that the engine 1 is not running, the CPU 10 cancels the interception of the OPERATE command (Step S8).

If Step S5 determines that the revolution speed of the engine 1 is less than the complete explosion end speed (for example, 400 rpm), the CPU 10 makes a determination as to whether a time duration in which the power of the battery 4 is supplied to the starter motor 2 with the contact point X of the relay X of the activation circuit turned ON, is a prescribed time duration (for example, 5 seconds) or more (Step S9).

If it is determined in Step S9 that the power is supplied from the battery 4 to the starter motor 2 over the prescribed time duration, the Step S6 and the subsequent processing are carried out. If Step S9 determines that the power supply duration from the battery 4 to the starter motor 2 is less than the prescribed time duration (for example, 5 seconds), that is, Step S9 determines that the time required for the starter motor 2 to start the engine 1 is less than the prescribed time duration, the routine returns to Step S5 and continues the start operation of the engine 1.

The CPU 10 carries out Step S7 and the subsequent processing if Step S1 determines that the starter switch ST is not pressed down, or if Step S2 determines that the OPERATE command is prohibited, or if Step S3 determines that the engine is not running or that the revolution speed of the engine is equal to or more than 100 rpm.

Figure 3:
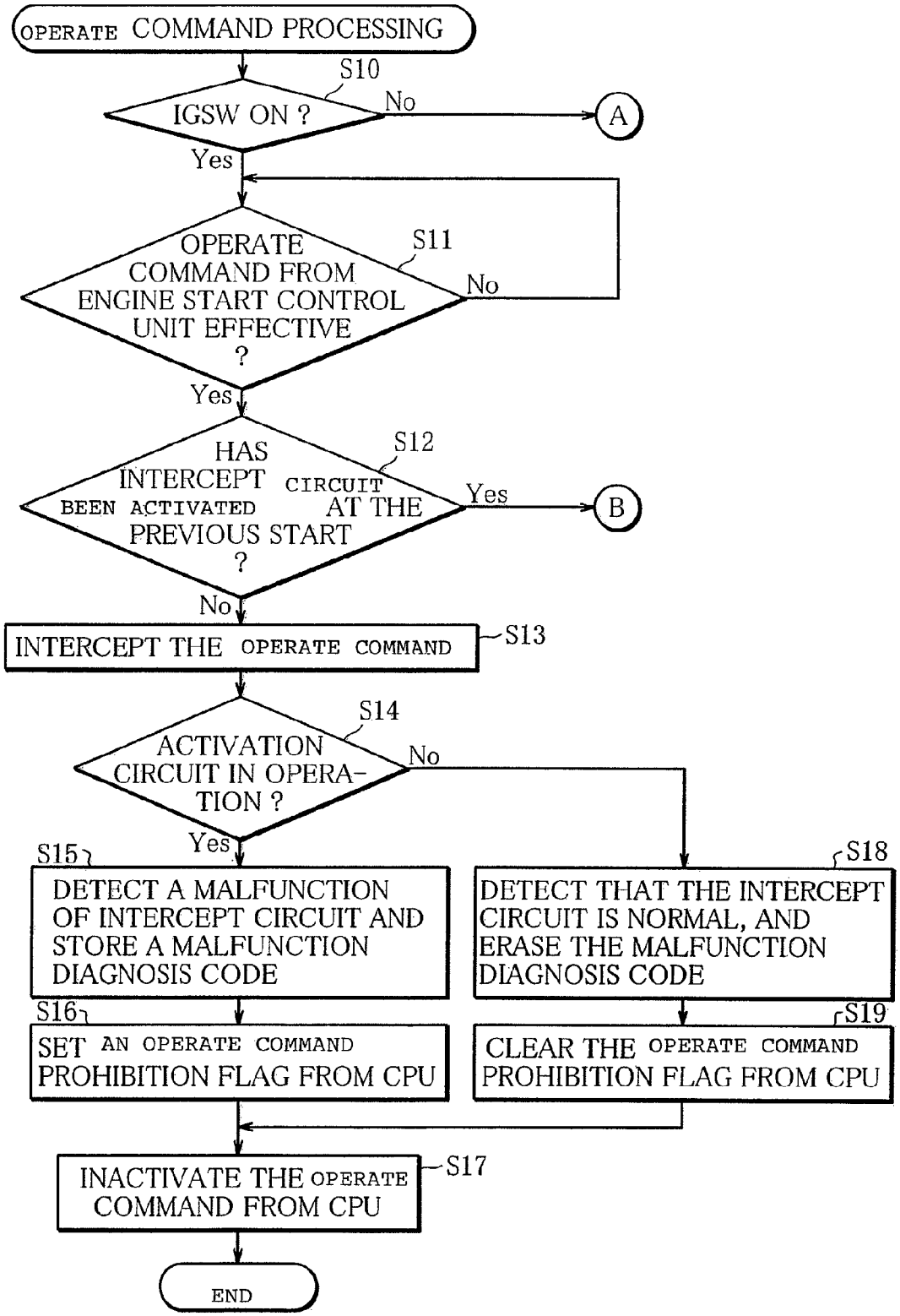
FIG. 3 is a flowchart showing an algorithm of START command processing shown in FIG. 2.
Figure 4:
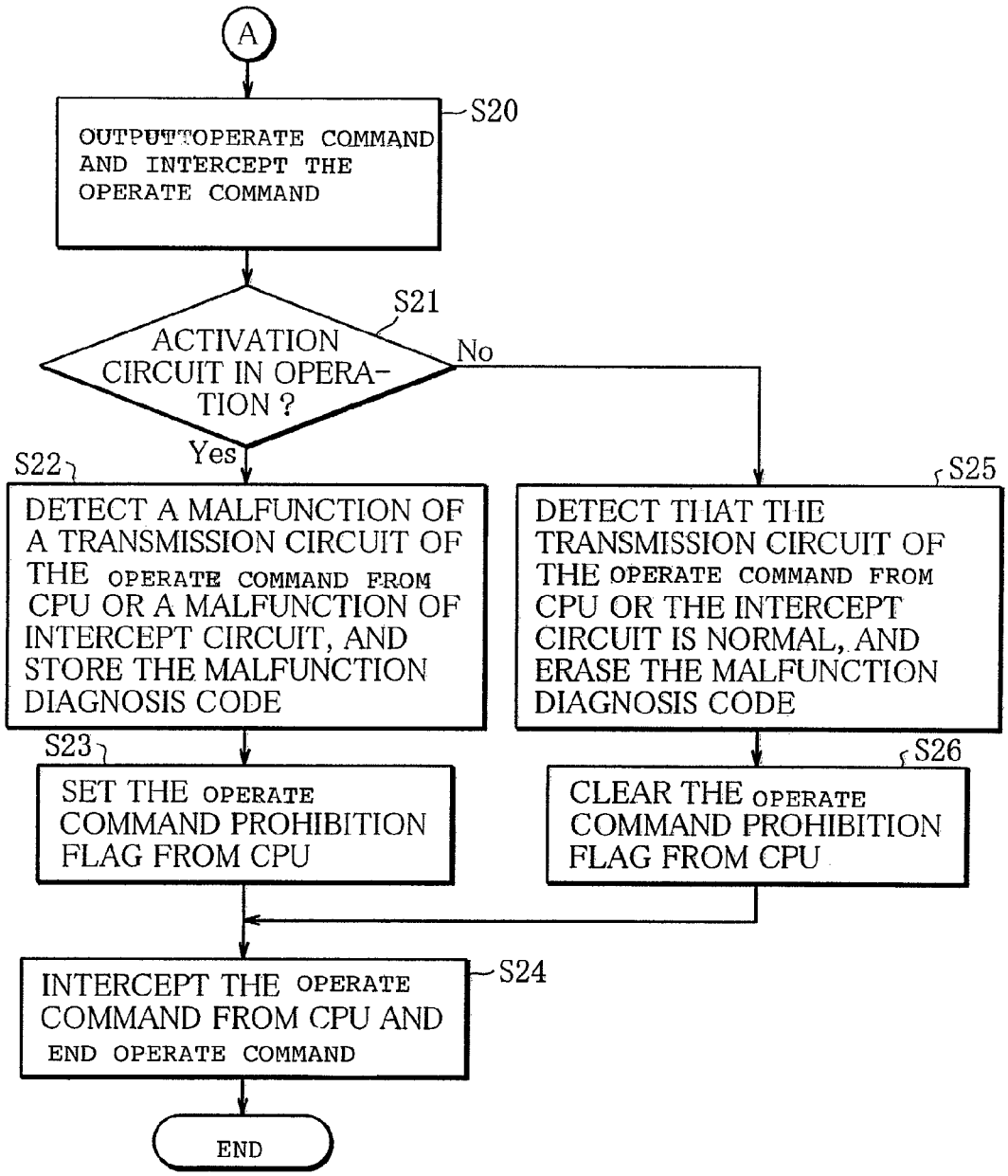
FIG. 4 is a flowchart showing the subsequent part of the algorithm of the START command processing shown in FIG. 3.
Figure 5:
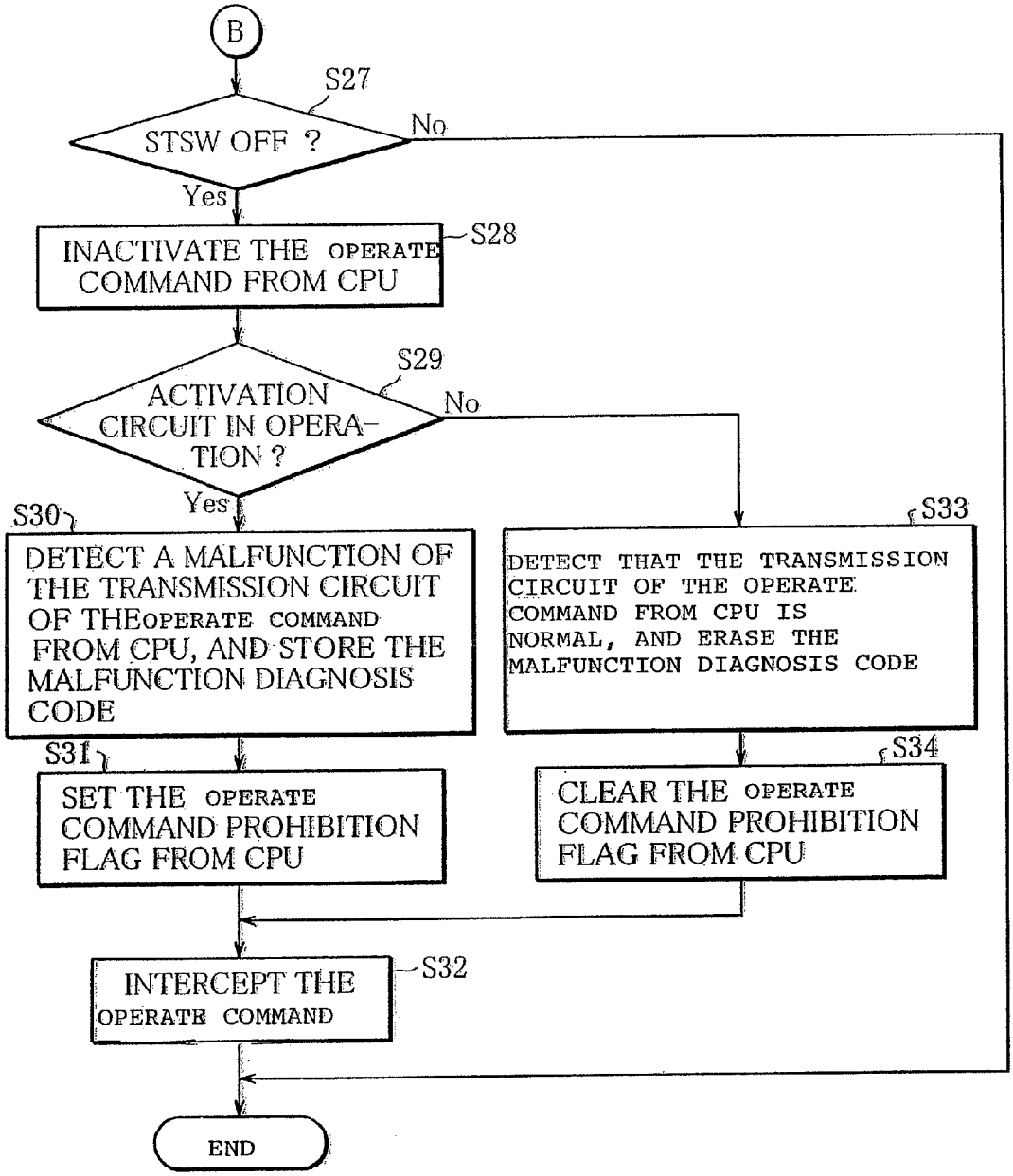
FIG. 5 is a flowchart showing another subsequent part of the algorithm of the START command processing shown in FIG. 3.

The OPERATE command processing that is carried out by the CPU 10 in Step S6 will be described below in detail with reference to flowcharts shown in FIGS. 3 to 5.

The CPU 10 detects a position of the ignition switch IG from the operation-enable-signal input terminal IGSW (Step S10). If determining that the ignition switch IG is ON, the CPU 10 further makes a determination as to whether the OPERATE command from the engine start control unit (engine ECU 5) is effective (Step S11). If Step S11 determines that the OPERATE command from the engine ECU 5 is effective, the CPU 10 makes a determination as to whether intercept circuit has been activated at the time of the previous start (Step S12). If Step S12 determines that the intercept circuit has not been activated at the time of the previous start, the CPU 10 intercepts the OPERATE command (Step S13).

The CPU 10 subsequently determines if the activation circuit is in operation (Step S14). If the activation circuit is in operation, it is detected that an intercept circuit has a malfunction, and a malfunction diagnosis code is stored (Step S15). Thereafter, an OPERATE command prohibition flag from the CPU 10 is set (Step S16). The OPERATE command from the CPU 10 is inactivated (Step S17), and the Operate command processing is ended.

If Step S14 determines that the activation circuit is not in operation, it is detected that the intercept circuit is normal, and the malfunction diagnosis code is erased (Step S18). The OPERATE command prohibition flag from the CPU 10 is cleared (Step S19), and Step S17 is carried out.

If Step S10 determines that the ignition switch IG is OFF, the OPERATE command from the CPU 10 is activated, and the OPERATE command is intercepted (Step S20). Thereafter, a determination is made as to whether the activation circuit is in operation (Step S21). If the activation circuit is in operation, it is detected that there is a malfunction in a transmission circuit of the OPERATE command from the CPU 10 or an intercept circuit, and the malfunction diagnosis code is stored (Step S22). The OPERATE command prohibition flag from the CPU 10 is set (Step S23). At the same time, the OPERATE command from the CPU 10 and the OPERATE command are intercepted, and the OPERATE command processing is ended (Step S24).

If Step S21 determines that the activation circuit is not in operation, it is detected that the transmission circuit of the OPERATE command from the CPU 10 or the intercept circuit is normal, and the malfunction diagnosis code is erased (Step S25). The OPERATE command prohibition flag from the CPU 10 is then cleared (Step S26), and the OPERATE command is ended (Step S24).

If Step S12 determines that the intercept circuit has been activated at the previous start, the CPU 10 makes a determination as to whether the starter switch ST is pressed down (ON) or not (OFF) (Step S27). If Step S27 determines that the starter switch ST is not pressed down, the OPERATE command from the CPU is inactivated (Step S28), and a determination is made as to whether the activation circuit is in operation (Step S29).

If Step S29 determines that the activation circuit is in operation, it is detected that the transmission circuit of the OPERATE command from the CPU 10 has a malfunction, and the malfunction diagnosis code is stored (Step S30). The OPERATE command prohibition flag from the CPU 10 is set (Step S31), and the OPERATE command is intercepted (Step S32). The OPERATE command processing is then ended.

If Step S29 determines that the activation circuit is not in operation, it is detected that the transmission circuit of the START command from the CPU 10 is normal, and the malfunction diagnosis code is erased (Step S33). The OPERATE command prohibition flag from the CPU 10 is cleared (Step S34), and Step S32 and the subsequent processing are carried out. If Step S27 determines that the starter switch ST is pressed down, the OPERATE command processing is ended.

The OPERATE command may be implemented (1) simultaneously with the interception, (2) after the interception, or (3) prior to the interception. If the interception is carried out after the issue of the OPERATE command, it is desirable that a time duration between the issue of the OPERATE command and the start of the interception (delay time) be set within a time limit before the starter motor is actually rotated.

As described above, the CPU 10 serves as complete explosion start-detecting means that detects the end of complete explosion start of the engine 1, monitoring means that monitors the operation of the activation circuit, storage means that stores the START command from the starter switch ST, and error-detecting means that detects an abnormal condition of the engine start controller.

Means for avoiding a constant ON state of the register by using the engine start controller of the invention will be described below.

When a CPU such as a microcomputer constructing the engine ECU 5 improperly operates, and a false OPERATE command is sent to the activation circuit, the engine ECU 5 activates the start intercept terminal COFF. The transistor Q1 is then turned on, and the base of the transistor Q2 is reduced to a ground potential. As a result, the activation-signal output terminal EGON, even if being in the active state, is inactivated by the transistor Q1. This prevents an improper start of the engine 1.

Needless to say, if the starter switch ST is pressed down, but the start-signal input terminal STSW of the engine ECU 5 is not activated, the start intercept terminal COFF may be kept in the active state so that the engine 1 does not start. It is desirable to do so because the false start of the engine 1 can be more credibly prevented.

Means for detecting a defect of the relay X by using the engine start controller of the invention will be described below. As mentioned above, the line m2 extending through the current-limiting resistor RB3 from the line connecting the transistor Q3 and the switch SW to each other is connected to the relay status detection terminal STRY of the CPU 10. The line m1 from the line connecting the switch SW and the relay X to each other is connected to the relay voltage detection terminal STA that detects the condition of voltage supplied to the relay X.

The relay status detection terminal STRY and the relay voltage detection terminal STA monitor the voltage applied to the relay X. When it is confirmed that a serge voltage equal to or more than a stipulated voltage (voltage larger than a withstand voltage of the transistor Q3) is produced in the voltage applied to the relay X, the CPU 10 determines that the relay X has a malfunction.

Alternatively, if the monitor lines m1 and m2 are used, it is possible to detect excessive serge voltage that is created, for example, when components other than those specified are attached to the relay X, or when the resistor disposed in the relay X to suppress the serge voltage is disconnected.

The engine start controller of the invention is capable of detecting a malfunction of the relay X by using the monitor lines m1 and m2. Therefore, the engine start controller can be increased in maintainability.

The engine start controller further has a bypass circuit that directly provides the relay X with the START command that has been sent by the starter switch ST. The bypass circuit makes it possible to start engine without fail even in a situation where the voltage of the battery 4 is transiently reduced by the start inrush current flowing through the starter motor 2 at the time of starting the engine with the battery 4 reduced in capacity, and the engine ECU 5 is disabled by the voltage drop and fails to send the OPERATE command to the relay X.

If the engine ECU 5 outputs the OPERATE command for starting the engine 1 without the START command from the starter switch ST for some reason, it is still possible to prevent the false start of the engine 1 in spite of the improper operation of the engine ECU 5, because of the intercept unit that intercepts such an OPERATE command.

The engine ECU 5 has the revolution-detecting means (for example, the crank angle sensor, a cam angle sensor, a starter active signal, an airflow sensor, etc.) attached to the engine 1. Therefore, if the revolution-detecting means detects that the engine is running without the START command from the starter switch ST, the start intercept terminal COFF reliably intercepts the OPERATE command sent to the activation circuit. Accordingly, even if the engine ECU improperly operates for some reason, the false start of the engine can be prevented.

The control system of the engine start controller has a redundant configuration so that the engine start control unit issues the OPERATE command when the engine start controller receives the START command from the starter switch ST, and the crank angle sensor 3 detects the revolution of the engine 1. For example, the engine 1 is prevented from being improperly started without the user's operating the starter switch ST in a situation where the engine start control unit causes a reading error of the register that maintains the state of the starter switch ST (improper operation that results from the constant ON state of the register, effects of radiation, etc.). The invention further enables to prevent the start duration from being increased by an amount of time required for recognition of the START command of the starter switch ST (for example, 500 milliseconds).

If the CPU 10 is reset after the voltage of the battery 4 is instantaneously reduced due to capacity insufficiency when the engine 1 starts running in response to the START command of the starter switch ST, the crank angle sensor 3 detects the revolution of the engine 1 increasing as the voltage of the battery 4 is restored to some degree, and the CPU 10 issues the OPERATE command. Therefore, the start of the engine 1 can be further reliably improved.

Even if there occurs the problem, for example, that the starter switch ST has a mechanical trouble and is brought into a constant ON state (constant ON position of the starter switch ST), the OPERATE command is intercepted after the complete explosion start of the engine 1. It is then possible to prevent the starter motor 2 from continuing to rotate after the complete explosion start of the engine 1. Since the starter motor 2 is prevented from continuing to rotate after the complete explosion start of the engine 1, it is possible to avoid a malfunction of a clutch that is located between the starter motor 2 and the engine 1 (malfunction caused by clutch engagement after the engine start).

The engine start controller detects an error of the intercept unit or the engine start control unit on the basis of the monitoring result of the CPU 10. It is therefor possible to prevent an improper operation of the engine start controller even if an error occurs in the intercept unit or the engine start control unit.

When the engine start control unit inactivates the OPERATE command after the intercept unit intercepts the OPERATE command, if the operation of the activation circuit is detected in spite that the intercept unit has intercepted the OPERATE command from the engine start control unit, the error-detecting means detects that the intercept unit has an error. Therefore, the improper operation of the engine start controller can be prevented even if an error occurs in the intercept unit.

If the OPERATE command from the engine start control unit is intercepted by the intercept unit after the engine start control unit inactivates the OPERATE command, and the operation of the activation circuit is detected by the monitoring means in spite of absence of the START command from the starter switch, the error-detecting means detects that the engine start control unit has an error. Therefore, the improper operation of the engine start controller can be prevented even if an error occurs in the engine start control unit.

The engine start controller correctly determines which of the intercept unit and the engine start control unit has an error because an error of the intercept unit and that of the engine start control unit are alternately detected every time the engine 1 is activated by the starter switch ST on the basis of the state detected by the error-detecting means (error-detection result) (Step S12).

The engine start controller is capable of properly avoiding the false start of the engine 1 since the OPERATE command of the engine start control unit is inactivated by using the error detection result (Step S17). Especially, if the OPERATE command of the engine start control unit is inactivated by using more than one error detection results, the engine start controller of the invention is capable of further effectively avoiding the false start of the engine 1.

The engine start controller exerts practically significant advantages, including the prevention of improper operation of the engine start control unit in the event of an error in the intercept unit or the engine start control unit, even if the engine start controller has a system that uses the starter switch ST and the ignition switch IG at the same time.

The engine start controller of the invention is not limited to the above-described embodiments shown in the drawings. Various modifications can be made without deviating from the gist of the invention.

What is claimed is:

1. An engine start controller, comprising:

a battery;

a starter motor driven by the battery to start an engine;

an activation switch that outputs a START command for starting the engine;

an engine start control unit directly connected to the activation switch and outputs an OPERATE command when the START command is received from the activation switch;

a bypass circuit directly connected to the activation switch, such that both the engine start control unit and the bypass circuit receive the START command simultaneously;

an activation circuit connected to the engine start control unit and the bypass circuit, and connects the starter motor to the battery to activate the starter motor when at least one of the OPERATE command output from the engine start control unit and the START command via the bypass circuit is received; and revolution-detecting unit that detects a revolution of the engine, wherein, the engine start control unit outputs the OPERATE command when the engine start control unit receives the START command from the activation switch, and also determines, based on the detected revolution of the engine, that the engine is rotating at a speed less than a predetermined value due to the START command received via the bypass circuit.

2. The engine start controller according to claim 1, further comprising:

an intercept unit that intercepts the OPERATE command if the OPERATE command is sent from the engine start control unit to the activation circuit without the START command from the activation switch.

3. The engine start controller according to claim 2, further comprising:

a complete explosion start-detecting unit that detects a complete explosion start of the engine on the basis of a detection result of the revolution detecting unit, wherein, the intercept unit intercepts the OPERATE command from the engine start control unit when the complete explosion start-detecting means detects the complete explosion start of the engine.

4. The engine start controller according to claim 1, further comprising:

a complete explosion start-detecting unit that detects a complete explosion start of the engine on the basis of a detection result of the revolution-detecting means, wherein, the engine start control unit terminates the OPERATE command when the complete explosion start-detecting unit detects the complete explosion start of the engine.

5. The engine start controller according to claim 2, further comprising:

a monitoring unit that monitors the operation of the activation unit; and an error-detecting unit that detects an error of at least either one of the intercept unit and the engine start control unit on the basis of a monitoring result of the monitoring unit.

6. The engine start controller according to claim 5, wherein:

the error-detecting unit determines that the intercept unit has an error when the monitoring unit detects the operation of the activation circuit even when the engine start control unit terminates the OPERATE command after the intercept unit intercepts the OPERATE command.

7. The engine start controller according to claim 5, wherein:

the error-detecting unit determines that the engine start control unit has an error when the monitoring unit detects the operation of the activation circuit even when the START command is not output from the activation switch in a situation where the intercept unit intercepts the OPERATE command after the engine start control unit outputs the OPERATE command.

8. The engine start controller according to claim 5, further comprising:

a storage unit that stores the START command output from the activation switch, wherein, the error-detecting unit alternately detects an error of the intercept unit and an error of the engine start control unit on the basis of a storage result of the storage unit each time the engine is activated by the activation switch.

9. The engine start controller according to claim 5, wherein:

the engine start control unit terminates the OPERATE command when the error-detecting unit detects an error of the intercept unit or an error of the engine start control unit at least once.

10. The engine start controller according to claims 2, further comprising:

an ignition switch that issues an ENABLE command, when the ignition switch is ON, provided independently of the activation switch, wherein, when the ignition switch is OFF, the intercept unit intercepts the OPERATE command from the engine start control unit to prevent operation of the starter motor.

11. An engine start controller comprising:

a battery;

a starter motor driven by the battery to start an engine;

an activation switch that outputs a START command for starting the engine;

an engine start control unit directly connected to the activation switch and outputs an OPERATE command when the START command is received from the activation switch;

a bypass circuit directly connected to the activation switch, such that both the engine start control unit and the bypass circuit receive the START command simultaneously;

an activation circuit connected to the engine start control unit and the bypass circuit, and connects the starter motor to the battery to activate the starter motor when at least one of the OPERATE command output from the engine start control unit and the START command via the bypass circuit is received; and an intercept unit, connected to the engine start control unit, that intercepts the OPERATE command if the OPERATE command is output to the activation circuit without the START command from the activation switch.

* * * * *